United States Patent [19]

Lents et al.

[11] 4,423,830

[45] Jan. 3, 1984

[54] APPARATUS FOR STORING AND DISPENSING PARTICULATE ICE

[75] Inventors: Charles M. Lents, Leon Valley; Craig A. Swanson, San Antonio, both of Tex.

[73] Assignee: Stainless Icetainer Company, San Antonio, Tex.

[21] Appl. No.: 181,321

[22] Filed: Aug. 25, 1980

[51] Int. Cl.[3] ..... B67D 5/62

[52] U.S. Cl. ..... 222/146 C; 62/394; 366/144; 222/242; 222/189

[58] Field of Search ..... 62/392, 394, 395; 366/144; 222/146 C, 239–242, 273, 274, 189, 410; 209/675, 659, 621; 220/468

[56] References Cited

U.S. PATENT DOCUMENTS

| | | | |
|---|---|---|---|
| 2,871,675 | 2/1959 | Cornelius | 62/394 |
| 3,067,591 | 12/1962 | Lingle | 222/239 |
| 3,144,965 | 8/1964 | Burton et al. | 222/240 |
| 3,387,750 | 6/1968 | Stencil | 222/410 |
| 3,557,868 | 1/1971 | Burkell | 62/394 |
| 4,215,803 | 8/1980 | Schafer | 222/240 |
| 4,228,938 | 10/1980 | Carr | 222/240 |
| 4,254,896 | 3/1981 | Stanford et al. | 222/410 |

FOREIGN PATENT DOCUMENTS

| | | | |
|---|---|---|---|
| 563312 | 6/1975 | Switzerland | 222/146 X |

*Primary Examiner*—H. Grant Skaggs
*Attorney, Agent, or Firm*—Henry C. Kovar

[57] ABSTRACT

Dispenser apparatus for particulate ice and/or ice cooled beverage has an ice bin with upright walls about a substantially vertical axis, a bottom canted rearwardly, a transverse ice discharge chute coplanar with the bin bottom and having a width continually divergent from the bin, a metallic ice dispensing chute point is secured in a resin bin wall on a downstream side of a dispensing rotor sweep and a self-closing dispensing door on an outlet of the chute has a barrier and a limit stop for placing the barrier in the path of ice being dispensed when the door is fully opened, an elongate drainage slot for melt water is in the bin bottom and extends radially outward from an axis of dispensing rotor rotation, a drain port extends from within the drain slot and is at a level below a level of the chute outlet, an ice dispensing rotor is within the bin and is revolvable about an axis canted rearwardly from the axis of the bin; the rotor has a hub, a ring, a plurality of paddlewheels mounted to the ring, entry rings on top of the paddlewheels for precluding admittance of oversize ice into the paddlewheels, and a helical agitator above the paddlewheels, the agitator has an axis eccentric to both of the rotor axis and the bin axis, and a separator shelf and barrier is above the rotor for lifting oversize ice off of the entry rings; a cold plate for cooling beverage is sealed to the bottom of tubular bin walls and the plate and walls are structurally secured together by foamed-in-place thermal insulation, a motor mount for an ice dispenser motor and mounts for the bin assembly are embedded, and thermally isolated, and structurally retained in the assembly by the thermal insulation.

24 Claims, 15 Drawing Figures

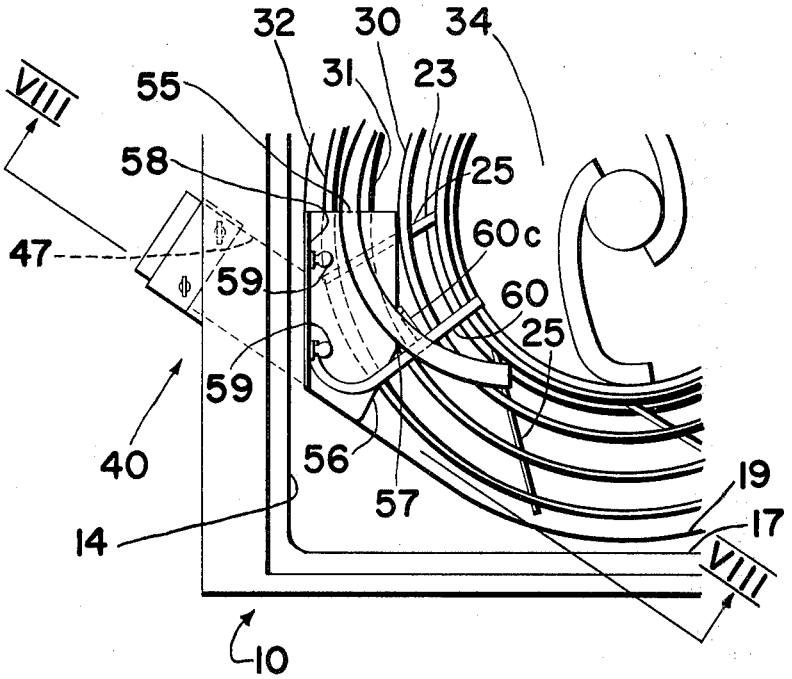
FIG. 7
FIG. 8
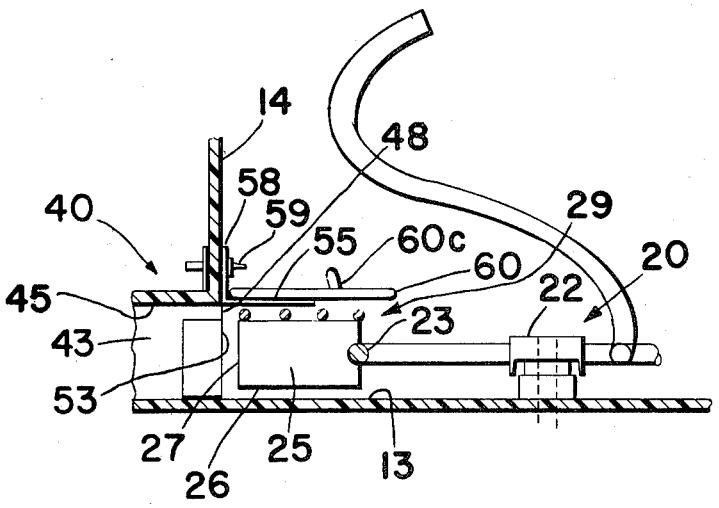

APPARATUS FOR STORING AND DISPENSING PARTICULATE ICE

BACKGROUND OF THE INVENTION

1. Field of the Invention

This invention pertains to apparatus for dispensing particulate ice and/or ice cooled beverage; the apparatus has an improved ice storage bin which can include a heat exchanger cold plate for beverage cooling, a new ice discharge impeller, melt water drain, and discharge port for the ice.

2. The Prior Art

Ice cooled beverage dispensers have been around for quite a while. The typical construction has an insulated bin, a door in the bin for loading and unloading of ice cubes, a cold plate in the bottom of the bin, and beverage dispensing valves above the bin. Particulate ice is dumped into the bin and on to the cold plate, either manually or by automatic feed from an automatic ice maker.Beverage is then run through the cold plate, the ice melts and is consumed to cool the beverage, and the beverage is dispensed to a cup. The user of the dispenser leaves the bin door open, or else opens the door and gets ice either with a scoop or his/her hand, and puts the ice in the drink.

This has become an objectionable practice to health and sanitation departments, to the parent soft drink companies, to fast food franchises and retailers, and to customers. The practice of leaving the bin door open effects frequent contamination of the ice due to insects and spilled beverage. Manual handling of the ice is now unacceptable to health departments, and it takes too much time and is too erratic in quantity for the fast food retailers.

Combined electro-mechanical refrigeration for beverage cooling together with a separate ice maker and ice dispenser has been one solution. However, this requires discrete machines for dispensing, for cooling, for ice making and for ice dispensing. The beverage and ice dispensers are logistically spaced from one another. The cost is exorbitant. There are too many components prone to failure.

Reynolds Products, Inc. of Schaumberg, Ill., has combined an ice maker and dispenser with a beverage dispenser. D. S. Reynolds et al. U.S. Pat. No. 3,441,176 to Reynolds is representative of this work.

Remcor Products of Chicago, Ill. has also combined an ice maker with a beverage dispenser and ice dispenser. The structure of the ice dispenser per se is subject of J. M. Whalen U.S. Pat. No. 3,517,860. This patent shows only the ice dispenser.

These units have provided for sanitary dispensing of ice and/or iced beverages. The machine user never touches the ice. These machines can be placed in self-service cafeterias where the customer self-helps to both ice and beverage without contact and without contamination of either the ice or the beverage.

For good reason, the public has taken a liking to this type of machine, and replacement of the prior separate ice bin and dispensing system appears to be not only desirable, but inevitable.

The Reynolds dispenser utilizes a Reynolds ice maker and is intended only for Reynolds ice. The Remcor dispenser is advertised to have "improved reliability" for "all types of ice" with the exception of flake ice.

It has been a continual battle to keep particulate ice dispensers operative, to avoid jamming, and to keep the cost of the machine economically feasible. Bin constructions have been complicated and have had excessive heat, motor noise, and vibration transfer through bin mounts and dispenser motor mounts and the bin door, and between the bin and the exterior shell of the dispenser. There have been problems with freeze-up and/or plug-up of melt water drains. There have been problems of breakage and/or erosion of the ice bin interior liners due to the hardness of ice being moved about in the bin. Jamming of ice in the discharge chute and in the outlet door has been a problem. Dispensing outlet doors have required solenoid or motor actuation and the necessary wiring and switches, and have been very noisy. These doors typically make a loud clanking noise upon both opening and closing. Over-run of ice dispensing has been a problem; specifically, after the dispenser has been shut off, ice will continue to fall out off of the dispenser outlet. Ice agglomeration within the bin and within the dispensing outlet has been a problem, particularly when different types of ice are used. Breaking and disposing of these agglomerations, which usually form overnight during the non-use period, is difficult. Quite often the machine user has to open the cover and manually break up the agglomeration with an ice pick.

In a combination of ice and beverage dispenser where the ice is used to cool the beverage, wet ice has been a problem due to continued melt-down of ice in the bin for beverage cooling, and then dispensing of whatever wet ice remains into a beverage cup. Disposal of melt water in order to keep the ice as dry as possible is a problem. Sanitation is also difficult with cleanability, disposal of melt water, impurities from melt water, galvanic corrosion and lubricating greases being problems.

OBJECTS OF THE INVENTION

It is an object of the present invention to provide a dispenser having an improved construction of ice bin with a cold plate structurally secured to a tubular bin by thermal insulation foam, such bin having improved thermal and sanitation characteristics and reduced transmission of vibration and noise.

It is an object of the present invention to provide a dispenser having an improved ice bin having bin mounts and dispenser motor mounts, with superior thermal insulation, with minimal transmission of motor noise, for thermal isolation of the motor from the interior of the bin, and of sanitary construction.

It is an object of the present invention to provide an improved resin bin which is resistant to abrasion from ice being moved around inside of the bin, and from ice being dispensed.

It is an object of the present invention to provide an ice dispenser having an improved drain for melt water which will not freeze up and which will maximize removal of melt water for keeping ice within the bin as dry as possible.

It is an object of the present invention to provide a particulate ice dispenser having an improved dispensing chute which will not jam either with particulate ice or with ice agglomeration in the chute, and which will not drip melt water from the ice.

It is an object of the present invention to provide a particulate ice dispenser having a dispenser rotor and structures above the rotor for lifting excess ice off of the rotor prior to feed of the ice into a dispensing outlet for preventing jamming of the oversize ice in the outlet.

It is an object of the present invention to provide a particulate ice dispenser with an improved self-actuating and self-closing ice outlet door which does not require solenoid actuation and which is extremely quiet when opening or closing.

It is an object of the present invention to provide an ice dispenser having an improved ice dispensing rotor for dispensing particulate ice.

It is an object of the present invention to provide a particulate ice dispenser having an improved agitator on a dispensing rotor for breaking up agglomerated ice in a storage bin.

It is an object of the present invention to provide a particulate ice dispenser having an agitator canted with respect to an ice bin within which it is rotatable, for breaking up ice agglomeration within the bin.

It is an object of the present invention to provide a particulate ice dispenser having a dispensing rotor which can sort ice by size and which will accept only a certain size or smaller particle for dispensing and which will leave agglomerated ice to be broken up before being accepted for dispensing, for preventing jamming by excessively large pieces of ice.

It is an object of the present invention to provide a combination particulate ice dispenser and beverage dispenser with an ice bin and a cold plate in the bottom of the bin having an improved ice dispensing rotor which will selectively dispense particulate ice of a certain size or smaller, and which will direct larger pieces of ice or ice agglomeration directly onto the cold plate for melt-down as refrigeration medium for beverage flowing through the cold plate.

It is an object of the present invention to provide an improved ice dispensing rotor in and/or for a particulate ice dispensing machine.

SUMMARY OF THE INVENTION

In accordance with the principles of the present invention, a dispenser for particulate ice and/or beverage has the discrete improvements of:

an improved ice bin with a cold plate adhesively secured to an upright extending tubular shell, with the cold plate and the shell being structurally secured to each other by thermal insulation;

an ice bin having a bottom sloped rearwardly from and lower than an outlet end of a transverse discharge chute, and a melt water drain at a level below a level of the chute outlet bottom;

an ice bin having a resin wall and a metallic ice chute point secured in the resin wall, the point being on the downstream side of a dispensing rotor rotational sweep;

an elongate drainage slot in the bin bottom, the slot extending radially outward underneath an ice dispensing rotor sweep and having a melt water drain port from within the slot;

an ice chute having walls defining an elongate port through which ice is expellable, the port being continually divergent from the bin;

a separating shelf extending into the ice bin and above a dispensing rotor with a convex V-shaped leading edge on the shelf;

a dispensing rotor having paddlewheels adjacent a bottom of an ice bin, an ice discharge chute extending transversely from the bin, and entry means above the paddlewheels for sizing ice together with a separating shelf above the paddlewheel sweep and the entry means, for lifting oversize ice off the entry means;

a dispensing door having a barrier and a limit stop to position the door, when open, with the barrier in the path of ice discharge;

a mount for supporting a dispensing motor is both retained to and thermally isolated from bin walls by foamed-in-place thermal insulation;

mounting lugs for the bin are secured to, spaced from, and thermally isolated from the bin walls by insulation foamed-in-place about the bin walls;

a dispensing rotor having a hub, a plurality of radial paddlewheels, and a generally helical agitator having an axis eccentric to an axis of the rotor;

a dispensing rotor having a hub, a plurality of paddlewheels, and entry means mounted to the paddlewheels for precluding passage of oversize ice into the paddlewheels;

an ice storage bin having upright walls about a substantially vertical axis together with a rotor and agitator mounted on and rotatable about an axis canted from the bin axis; and an ice dispensing rotor above a beverage cooling cold plate in the bottom of an ice bin, the rotor has a plurality of spaced apart paddlewheels, entry means on top of the paddlewheels for precluding entry of oversize ice into the paddlewheels, and a substantially open center section within the paddlewheels and entry means, for directing oversize ice onto the cold plate.

BRIEF DESCRIPTION OF THE DRAWINGS

FIG. 7 is a top plan view detail of a shelf and barrier associated with the ice discharge chute and rotor in the apparatus of FIG. 1;

FIG. 8 is an elevational sectional view taken through lines VIII—VIII of FIG. 7;

DESCRIPTION OF THE PREFERRED EMBODIMENT

Figure 1:
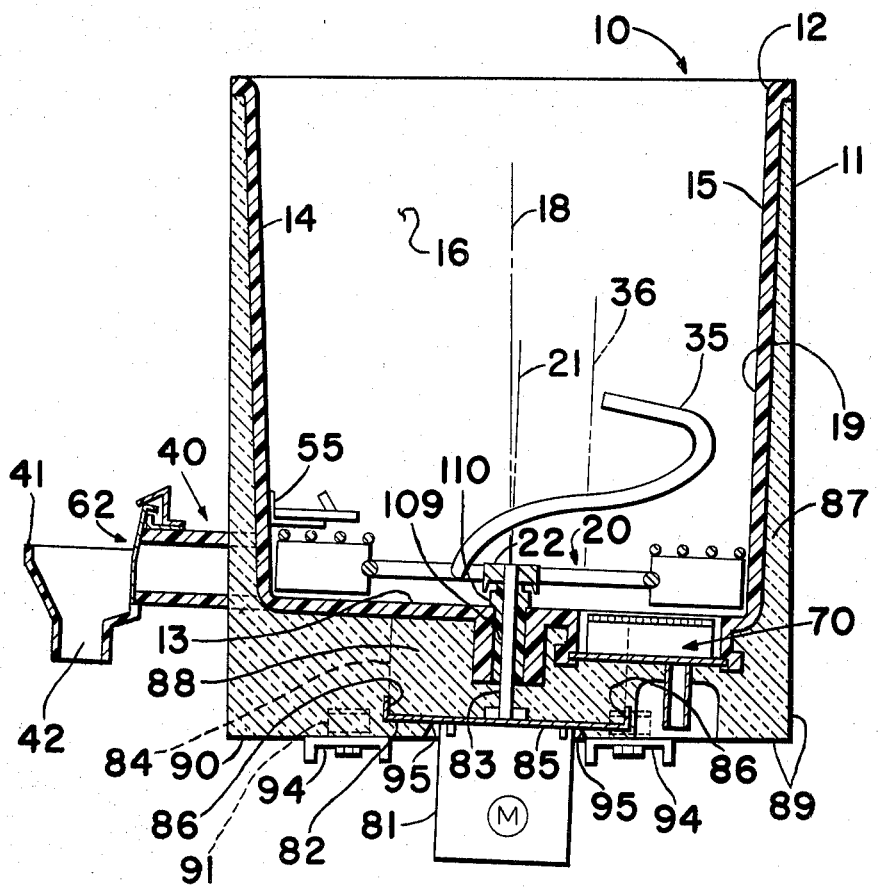
FIG. 1 is an elevational sectional view of the preferred embodiment of apparatus for dispensing particulate ice, in accordance with the present invention.

The principles of the present invention are particularly useful in the preferred embodiment of apparatus for dispensing particulate ice as shown in FIG. 1 and generally indicated by the numeral 10.

The ice dispenser apparatus 10 has an ice bin assembly 11 having a bin 12 with a bottom 13, front wall 14, rear wall 15, left side wall 16 and right side wall 17. The bin walls 14–17 form a section which extends upwardly about a substantially vertical axis 18 and which is generally rectangular when viewed from above. A circular section 19 adjoins the walls 14–17 to the bottom 13.

Figure 2:
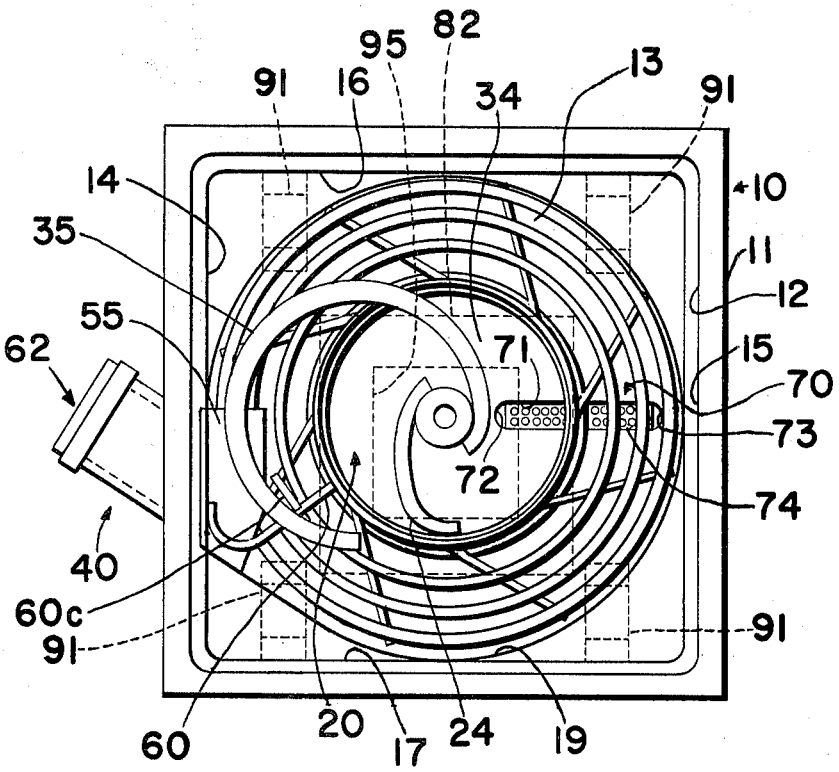
FIG. 2 is a top plan view of the apparatus of FIG. 1.
Figure 3:
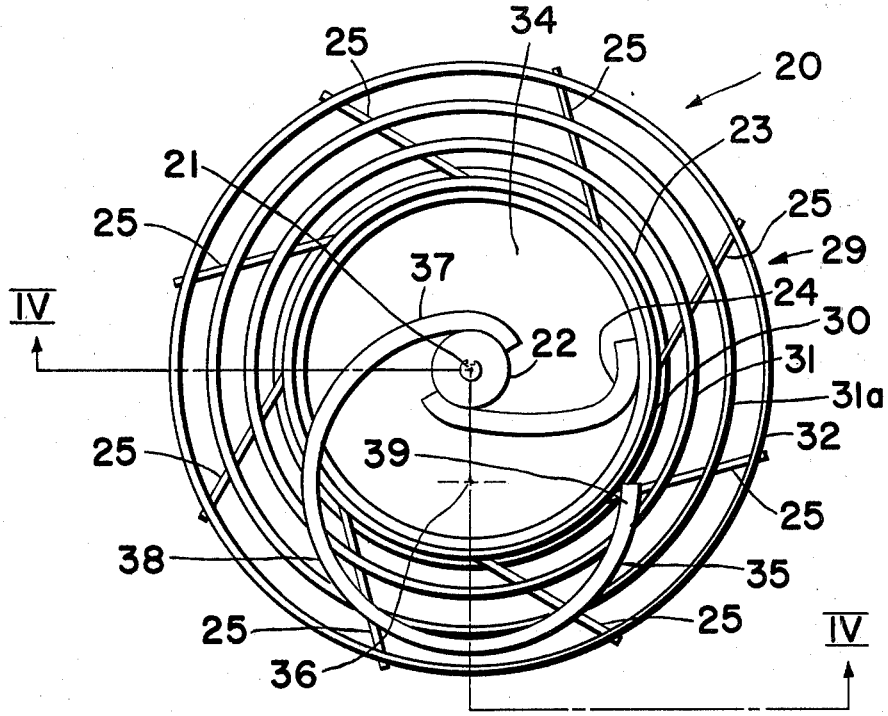
FIG. 3 is a top plan view of an ice dispensing rotor in the apparatus of FIG. 1.
Figure 4:
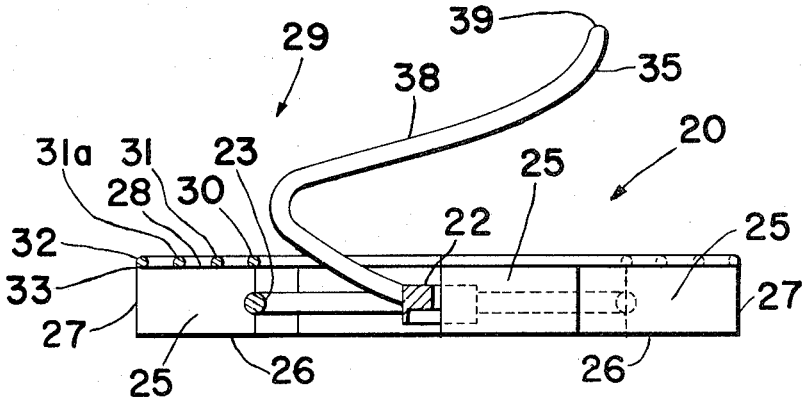
FIG. 4 is an elevational view, in partial section, of the rotor of FIG. 3, taken through lines IV—IV.

An ice dispensing rotor 20 shown in detail in FIGS. 3 & 4, is in the bin 12 adjacent the bottom 13 and is rotatable about a generally upright axis 21 and within the circular section 19 for expelling ice out of the bin 12; the rotation is CW as viewed in FIG. 2. The rotor 20 has a hub 22, a drive ring 23 concentric to and spaced radially outward from the hub 22, a trailing angle sweeper arm 24 which drivingly and structurally connects the ring 23 to the hub 22, and a plurality of arcuately spaced apart upright paddlewheels 25 mounted to the drive ring 23. Each paddlewheel 25 has a bottom edge 26 adjacent to the bin bottom 13, an outer edge 27 adjacent to the circular section 19, and a top edge 28 facing upwardly. Entry means, generally indicated by the numeral 29 are co-rotatably mounted to the paddlewheel edges for precluding entry of oversize ice into the paddlewheels 25. The entry means 29 are one or more sizing rings; a plurality of progressively larger size sizing rings is shown. There's an inner sizing ring 30, larger sizing rings 31, 31*a*, and a largest sizing ring 32 mounted to outside upper paddlewheel corners 33. The sizing rings 30–32 and drive ring 23 are all concentric to one another, and the spacings between adjacent rings, 23 to 30, 30 to 31, 31 to 31*a*, to 31*a* to 33, are all similar to each other and to a spacing between the drive ring 23 and the bottom 13. The sizing rings 30–32 are welded to the paddlewheel top edges 28 and structurally tie the paddlewheels 25 one to another. The rotor 20 has a substantially open center section 34 within and defined by the drive ring 23, the only structure being within this open center section 34 is the hub 22 and sweeper arm 24. The sweeper arm 24 is at a trailing angle of about 45 degrees, so that as it rotates, it pushes ice from the center of the bin 12 out to the paddlewheels 25. The drive ring 23 is a metal toroid, and the paddlewheels 25 are of equal height above and below the level of the toroidal drive ring 23, the drive ring 23 being midway between the paddlewheel top edge 28 and bottom edge 26. The drive ring 23 also functions as an entry means because oversize ice cannot pass through the spacing between the drive ring 23 and the bottom 13 and is precluded from entering the paddlewheels 25, nor can oversize ice pass through the spacing between the drive ring 23 and the inner sizing ring 30 which is directly above the drive ring 23. An agitator 35 is co-rotatably mounted to the rotor 20, and is in the form of a cantilevered helix having an axis 36 spaced eccentrically outward of the rotor axis 21. The agitator 35 has a nose 37 welded to the hub 22, a helically formed body 38 which winds upwardly and outwardly directly over the drive ring 23 and above at least one of the paddlewheels 25 and the entry means 29, and which then winds further upwardly and inwardly to a distal tail 39 which is over the drive ring 23 and which is pitched inwardly toward the center, or axis 18, of the bin 12. The helix of the agitator 35 is wound to feed upwardly as the rotor 20 is revolved. The paddlewheels 25 trail rearwardly at an angle greater than forty-five degrees, and ice of acceptable size or smaller is pushed radially outward during revolution of the rotor 20.

Figure 5:
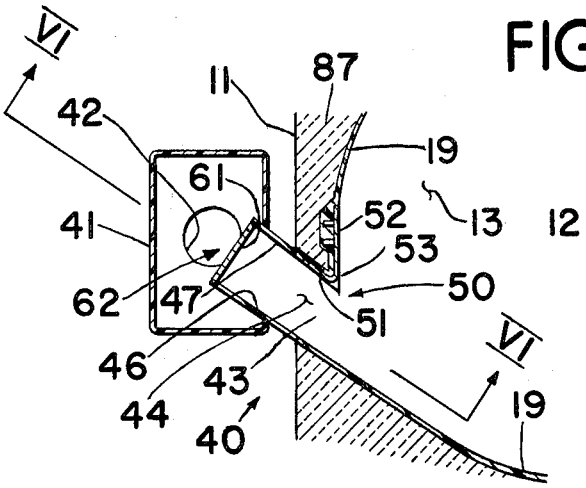
FIG. 5 is a horizontal sectional view looking downward through an ice dispensing chute in the apparatus of FIG. 1.
Figure 6:
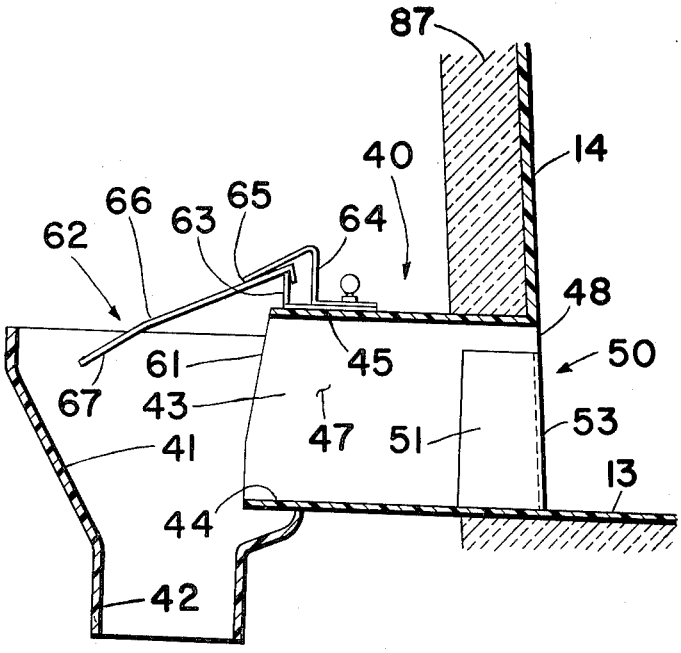
FIG. 6 is a vertical sectional view taken through lines VI—VI of FIG. 5.

An ice dispensing chute 40, shown in detail in FIGS. 5 & 6, extends out of the bin 12 and is provided for discharge of particulate ice to a delivery well 41 having an outlet 42 substantially smaller in diameter than a beverage cup (not shown). The chute 40 has an internal elongate port 43 through which ice is expellable. The port 43 is defined by a bottom 44, a top 45, an outer wall 46 and an inner wall 47. The chute bottom 44 is co-planar with the bin bottom 13, and parallel with the chute top 45. The chute outer wall 46 is substantially tangent to the bin circular section 19, the chute inner wall 47 is continually divergent from the outer wall 46 as measured going outward from the bin 12, this divergency being at least three degrees. The chute walls 46, 47 and bottom 44 and top 45 are integral with the bin 12 and are fabricated of resin with fiberglass reinforcement. The chute port 43 is at the same level as the rotor paddlewheels 25, and has an inlet end 48 at the intersection of the port 43 with the bin 12. The port 43 faces directly into and against the rotational sweep of the rotor 20, the sweep being considered to be the space through which the rotor 20 revolves, and the sweep of the paddlewheels 25 to be the space through which the paddlewheels 25 revolve.

A metallic ice chute point 50, also shown in detail in FIGS. 5 & 6, is secured in the resin wall where the chute inner wall 47 intersects with the bin front wall 14. The point 50 has a metallic panel 52 in and flush with the bin front wall 14, and a metallic panel 51 in and flush with the chute inner wall 47. The panels 51, 52 form an acute angle between themselves, and a metallic upright inner edge 53, at the intersection between the panels 51, 52, is substantially flush with both of the resin bin wall 14 and chute inner wall 47. The panels 51, 52 and edge 53 have a height at least equal to the height of the rotor 20, as measured at the paddlewheels 25, and the edge 53 is substantially at the same level as the rotor 20 and its paddlewheels 25. The edge 53 extends substantially the entire height of the chute port 43 and is on the downstream side of the rotor rotational sweep, and the port 45 and edge 53 face directly into the rotor rotational sweep. The edge 53 and panels 51, 52 are all backed up by resin material having a thickness at least as thick as the front wall 14 or the chute inner wall 47.

A separator shelf 55 shown in detail in FIGS. 7 & 8, extends into the bin 12 and is at a level generally the same as and co-planar with the top 45 of the chute port 43. The shelf 55 is over and at least as wide as the intersection of the port 43 with the bin 12. A convex V-shaped leading edge 56 is on the shelf 55 and has a leading point 57 generally midway between inner and outer radii of the paddlewheel rotational sweep; the leading point 57 is also substantially aligned with the inner upright wall 47 of the discharge port 43. The shelf 55 covers the entire intersection of the port 43 and is removably held to the bin front wall 14 by a fastening flange 58 and removable fasteners 59. The rotor agitator 35 when revolved, rotates in sweep directly over and above the shelf 55 for moving ice up off of the shelf 55. A bumper 60 is welded on and fixed to the shelf 55. The bumper 60 is a cantilevered resilient spring bar which is directly atop of the entry means 29 and above the paddlewheels 25. The bumper 60 is fixed with respect to the rotor 20 for bumping oversize ice particles up and off of the entry means 29 as the rotor 20 is rotated, and an upwardly inclined bumper cam 60*c* further assists to lift ice above the shelf 55 and into the agitator 35.

A door 62 shown best in FIG. 6, normally closes an outlet end 61 of the discharge chute 40. The door 62 is self-closing and is pivotally mounted with respect to the chute 40 by a base 63 and cap 64 fastened to the chute 40. The cap 64 has a limit stop 65 which abuttingly engages a main body 66 of the door 62 for positively limiting opening of the door 62 with respect to the chute 40. The door 62 is opened by the push of ice being forced out of the chute 40 and when opened, the chute outlet end 61 is substantially opened. When the door 62 is completely open and against the limit stop 65, the door 62 is positioned with a door barrier 67 positioned projecting into a projected section of the chute port 43 for breaking any agglomerated ice expelled out of the port 43 and directing the ice down into the delivery well 41. More specifically, a line of intersection between the barrier 67 and main body 66 is positioned generally co-planar with the port top 45 when the limit stop 65 is positioning the fully open door. The barrier 67 is turned downward from and is substantially shorter than the main body 66, and the chute outlet end 61 has a matching angled profile against which the door 62 closes. This door 62 is substantially smaller than any previous barrier type door.

The chute bottom 44 slopes downwardly from the outlet end 61 and the bin bottom 13 slopes downward from the inlet end 48 of the chute bottom 44. The bin bottom 13 is lower than, while being co-planar with, the chute bottom 44.

Figure 10:
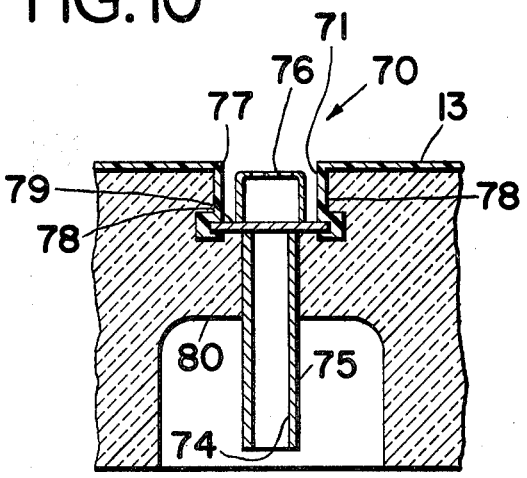
FIG. 10 is an elevational cross sectional end view through a melt water drain in the apparatus of FIG. 1.

A melt water drain 70 shown in FIGS. 1, 2 & 10, is fluidly connected into the bin 12 via the bin bottom 13. The drain 70 is at a level below the level of the chute bottom 44, and is on the opposite or rear side of the bin 12 from the discharge chute 40 which is on the frontside of the bin 12. The drain 70 includes an elongate recessed drain slot 71 in the bin bottom 13. The slot 71 extends radially outward underneath the rotor 20 sweep from adjacent the rotor axis 21 toward the bin rear wall 15. The slot 71 has a radially inward end 72 adjacent the rotor axis 21, and a radially outward end 73 furthest from the axis 21 and adjacent to the bin rear wall 15. A melt water drain port 74 is directed downwardly from within the slot 71 and from adjacent to the radially outward end 73. The drain port 74 is formed by a metal tube 75 having relatively high thermal conductive qualities. A perforate screen 76 spans across the slot 71. The screen 76 is recessed in the slot 71 below the level of the bin bottom 13 and below a downstream radial edge 77 of the slot 71. The edge 77 is downstream with reference to the direction of rotation of the rotor 20. In the structure of FIGS. 1, 2 & 10, the bin 12 and slot side walls 78 are made of a relatively low thermal conduction resin. A metal bottom 79 having relatively high thermal conductivity is connected to the metal drain tube 75 of similar conductive material. The drain tube 75 protrudes to ambient, and heat from ambient is carried via the tube 75 to the metal drain bottom 79 for melting slush or ice in the slot 71 for preventing freeze-ups or plugging of the drain 70.

An electric motor 81 is drivably connected to the rotor 20 and is selectively actuatable for selective rotation of the rotor 20. The motor 81 is suspended from the bin assembly 11 by a motor mount 82 integrally assembled into the bin assembly 11. A drive shaft 83 extends into the bin 12 and connects the motor 81 to the rotor 20. The motor mount 82 has a pair of tall flanges 84 which have edge-to-edge abutted contact with the underside of the bin bottom 13 and which space a mounting plate 85 from the bin bottom 13, providing a void between the plate 85 and the bin bottom 13 and the tall flanges 84. There is at least one and preferably two shorter flanges 86 between the tall flanges 84. These shorter flanges 86 are spaced from the bin bottom 13 and together with the tall flanges 84 shape the motor mount 82 into a box having an opening between itself and the bin bottom 13.

Foamed-in-place thermal insulation 87 surrounds and is structurally attached to the bin 12. The insulation 87 encloses the outside of the bin 12, is unitary and extends around the upright bin walls 14–17. A substantial quantity 88 of the insulation 87 is within the motor mount 82 in the void between the mounting plate 85 and the bin bottom 13 for thermally isolating the plate 85 and the motor 81 suspended therefrom, from the relatively cold bin bottom 13. The insulation 87 has an exterior foamed skin 89 forming the exterior of the bin assembly 11, and a substantially planar bottom surface skin 90 upon which the bin assembly 11 and the ice therein may be supported. A retainer 95 of insulation 87 is on the underside of the mount plate 85. The retainer 95 extends uninterruptedly around the entire perimeter of the mount plate 85 and supportively retains the motor mount 82 in the insulation 87 and to the bin assembly 11.

Figure 9:
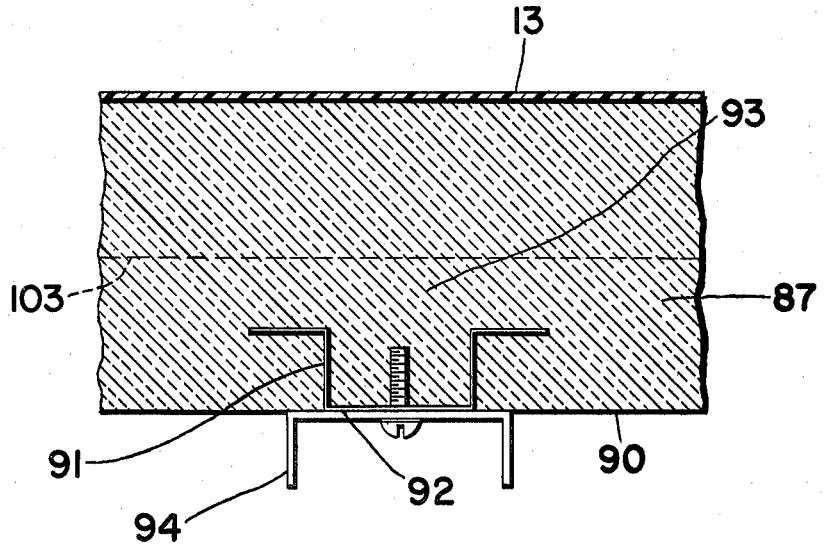
FIG. 9 is an elevational cross sectional view through a mounting lug in the apparatus of FIG. 1.

A plurality of bin mounting lugs 91 shown in FIG. 9, are buried in the insulation 87. Each lug 91 has a lower face 92 co-planar with the insulation bottom surface 90. Each lug 91 is spaced from the bin bottom 13 and preferably is an inverted hat section of metal as shown in FIG. 9. A substantial quantity of thermal insulation 93 spaces each lug 91 from the bin bottom 13, and the lugs 91 are removably fastenable to chassis members 94.

The insulation 87 including the skin 89, quantity 88 in the motor mount 82, and motor mount retainer 95 is integral and foamed-in-place as a singular construction. The spacing of the motor mount 82 and lugs 91 from the bottom 13 minimizes heat transfer, vibration transfer, assures no thermal sweating and/or corrosion from condensate, and assures structural integrity.

Figure 13:
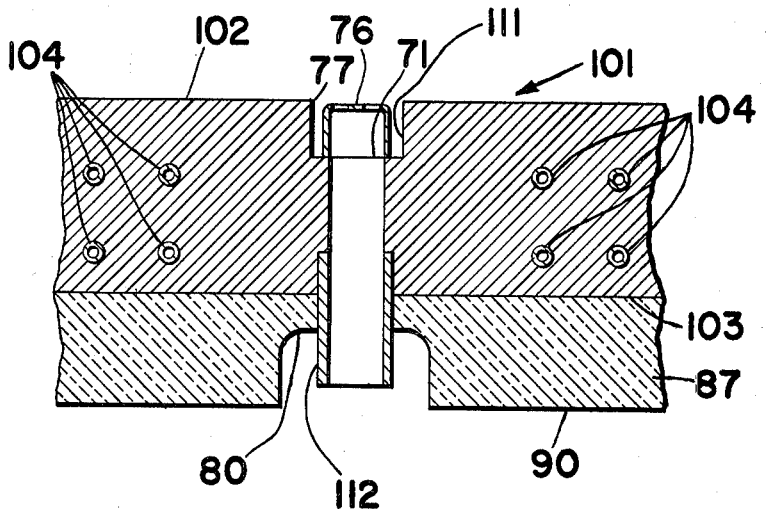
FIG. 13 is a vertical cross sectional view of a melt water drain through lines XIII—XIII of FIG. 14.
Figure 14:
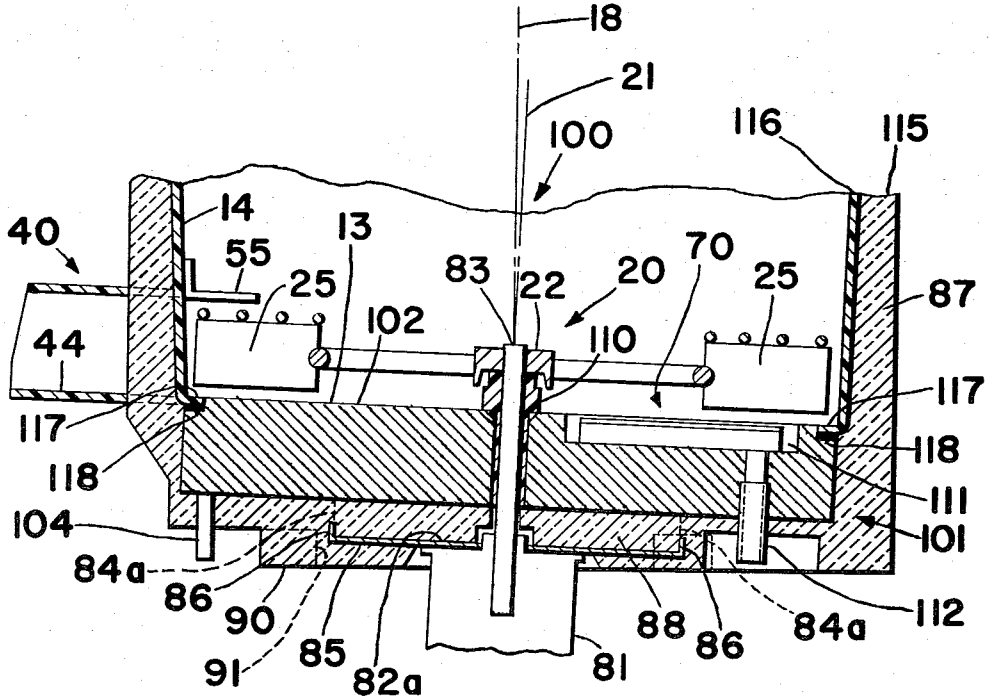
FIG. 14 is a vertical cross sectional view of the preferred embodiment of a combination particulate ice dispenser and ice-cooled beverage dispenser having the cold plate of FIG. 11 combined into the apparatus of FIG. 1.
Figure 15:
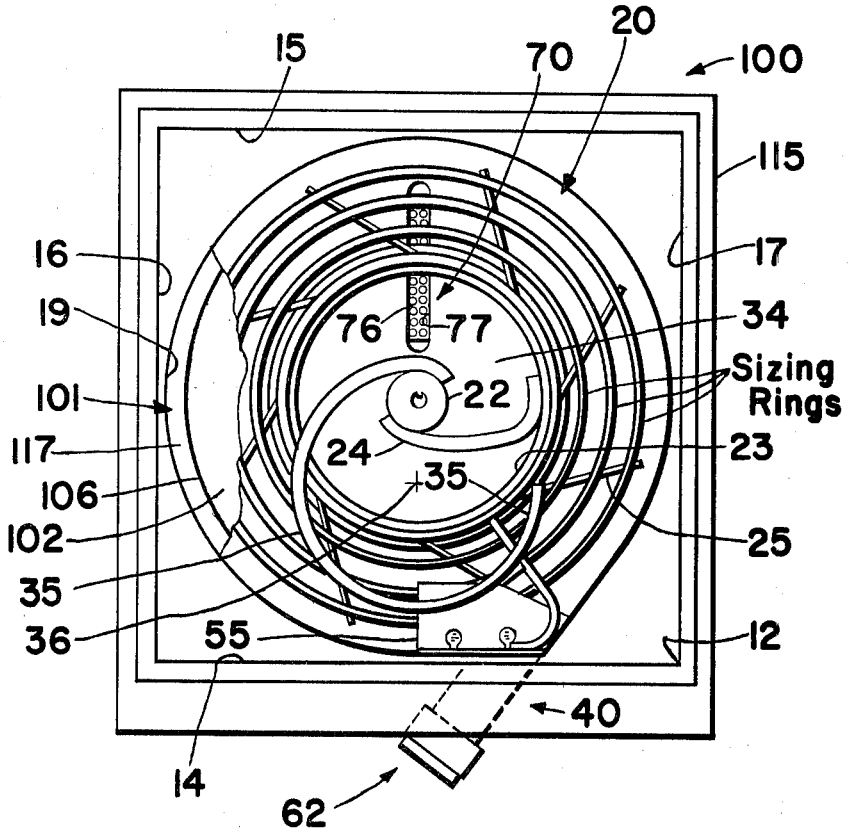
FIG. 15 is a top plan view of the apparatus of FIG. 14.

FIGS. 14 & 15 illustrate the preferred embodiment of an apparatus 100 for dispensing either ice or ice cooled beverage. The apparatus 100 is a combination ice dispenser and ice cooled beverage dispenser in which a cold plate 101, as shown in FIGS. 11, 12 & 13 has been combined into the apparatus 10 of FIG. 1.

Figure 11:
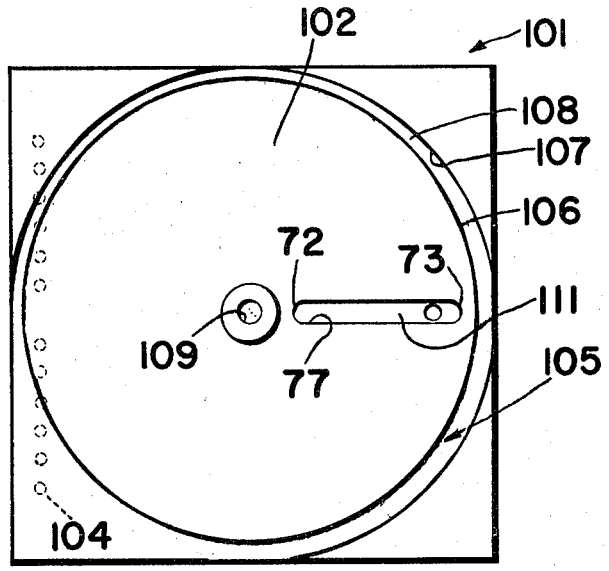
FIG. 11 is a top plan view of a cold plate specifically for combination with and into the apparatus of FIG. 1.
Figure 12:
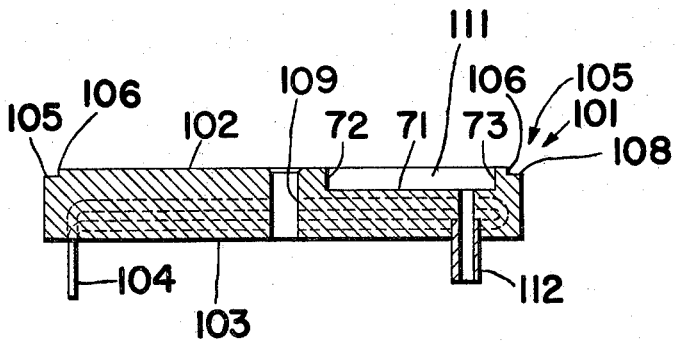
FIG. 12 is a vertical cross sectional view through lines XII—XII of FIG. 11.

The cold plate 101 shown in FIGS. 11–13 is cast aluminum and has an upper surface 102, a bottom 103, and embedded stainless steel beverage cooling coils 104. The upper surface 102 is surrounded by a rabbet 105 which is a circular annular groove having an inner edge 106, outer edge 107 and bottom 108. A central bore 109 is provided for a plastic bearing 110 as in FIG. 1, the rotor 20 and its driveshaft 83. A drain slot 111 is the physical equivalent of the drain slot 71 of FIGS. 1, 2 & 10. The same screen is used in either drains 70, 111. A metal drain tube 112 protrudes to ambient from the drain slot 111 and performs the same thermal transfer function previously described with respect to the drain 70 of the apparatus 10 of FIG. 1.

The apparatus 100 of FIGS. 14 & 15 has the cold plate 101 combined into an ice bin assembly 115 having a tubular shell 116 made from the bin 12 of FIGS. 1 &

2. The tubular shell 116 includes the resin front wall 14, rear wall 15, left side wall 16, rear side wall 17, circular section 19, and the dispensing chute 40 including its bottom 44. The center of the resin bottom 13 of the bin 12 has been cut out and removed, leaving an annular flange 117 inside the shell 116. The ice bin 12 of the apparatus 100 has its side walls formed by the tubular shell 116 and a bottom 13 formed by the aluminum cold plate 101 rather than the removed resin material. The dispensing rotor 20, dispensing chute 40, separator shelf 55, door 62, motor 81 and bin mounting lugs 91 are identical to and have not been changed from what has been previously described with respect to FIGS. 1–9.

The annular flange 117 is sealed in and to the rabbet 105 with a suitable watertight sealant-adhesive 118. The top of the annular flange 117, the discharge chute bottom 44 and the cold plate upper surface 102 are all flush and co-planar. The tubular shell 116 is mounted substantially vertical about axis 18 and the cold plate 101 is canted rearwardly and perpendicular to the rotor axis 21. The drain 111 is dimensionally identical to and canted rearward like previously described drain 70. The motor mount 82*a* has the same plate 85 and short flanges 86. The tall flanges 84*a* have been shortened by an amount equal to the thickness of the cold plate 101 less the thickness of the resin bottom 13, which places the mounting plate 85 in the same position regardless of whether in apparatus 10 or apparatus 100. There still remains a substantial quantity 88 of insulation within the void of the motor mount 82*a*.

The tubular shell 116 is structurally retained to the cold plate 101, in FIGS. 14 & 15, by the thermal insulation 87 which is foamed in place about and to a previously sealed together shell 116 and plate 101. The insulation physically adheres to and encloses the outsides of both the shell 116 and the plate 101 and forms the structure retaining them together. The resin annular flange 117 is tucked under the paddlewheels 25 and their rotation sweep. The bin bottom 13 and cold plate 101 with its upper surface 102 are all canted rearward a preferred two degrees.

The rotor 20 together with its agitator 35 are co-rotatable about the axis 21 canted with respect to the bin axis 18. With an agitator 35 of about $6\frac{3}{4}$ inches (120 mm) height, mounted and rotating on an axis 36 which is eccentric but parallel to the rotor axis 21, and with the rotor axis 21 being canted rearward a preferred two degrees, the agitator 35 will wobble with respect to the rectangular section bin 12. Preferably the bin 12 is of square cross section and the bin axis 18 and rotor axis 21 converge at the level of the bin bottom 13 or the cold plate upper surface 102, these being one and the same level, and the agitator 35 runs almost $\frac{1}{2}$ inch (12 mm) nearer to the rear wall 15 than to the front wall. This helps to break up ice agglomerations in the bin 12.

In the use and operation of the apparatus 10 and apparatus 100, the bin 12 is filled with particulate ice. The ice must be of a size that will pass through the entry means 29. The motor 81 is selectively actuated when dispensing of ice is desired. As the rotor 20 is driven around, particulate ice of a predetermined or smaller size passes through the entry means 29 and falls into the paddlewheels 25. The agitator 35 thrusts ice upwardly from above the paddlewheels 25. The motion effected in the ice by the agitator is essentially toroidal, the ice goes upward adjacent the bin walls 14–17 and falls downward above the rotor open center section 34. The agitator 35 moves ice above the paddlewheels 25 up and down as well as in and out against the bin walls 14–17 for breaking up agglomerations and keeping the ice as discrete particles. Agglomerations usually form overnight during time periods of non-use and during automatic filling of the bin 12 with an inventory of ice. The agitator 35 moves in and out from the walls 14–17 and angularly in and out due to the rectangular bin cross-section and the canted rotor axis 21. As the rotor 20 rotates, the sweeper arm 24 biases ice on the bottom 13 outwardly toward the drive ring 23. Particulate ice must be equal to or smaller than the distance between the bottom 13 and the drive ring 23, or between the drive ring 23 and the inner sizing ring 30 in order to pass from the open center section 34 into the paddlewheels 25. Oversize ice that is too large for dispensing is retained in the center section 34. The paddlewheels revolve in their sweep above the bottom 13 and ice within the paddlewheels 25 is cammed outwardly and rides against the bin circular section 19. The paddlewheels 25 rotate under the bumper 60 and separator shelf 55. The bumper 60 and shelf leading edge 56 and point 57 kick excess and all oversize ice up and off the entry means 29 and all load is taken off of ice within the paddlewheels 25 by virtue of the separating shelf supporting the ice over the discharge chute inlet end 48. The ice to be dispensed is unloaded by the shelf 55 and is pushed into the discharge chute 40. The individual paddlewheel 25 that is pushing ice into the chute 40 is approximately perpendicular to the chute 40 when expelling ice into the chute 40. As the ice goes into and through the chute port 43, the ice may expand between the divergent outer wall 46 and inner wall 47, and the metallic chute point 50 compressively snaps the ice either into or out of the chute port 43 without breakage or erosion of the resin bin 12. The ice being pushed by the rotor 20 opens the door 62 and falls off of the chute 40 and into the delivery well 41. If ice becomes agglomerated overnight in the chute 40, the barrier 67 breaks the agglomeration and directs ice downwardly. The door 62 is self-closing and does so under gravity. The door 62 does not make noise either when opening or closing and does not require a solenoid for opening and/or closing.

Drainage of melt water is down the rearward sloped chute bottom 44, then down the bin bottom 13 and into the drain slot 71 and out the drain port 74. The modest and intentional heat pick-up by the drain tube 75 keeps the drain 70 from freezing up and prevents dripping of melt water out the chute 40 and overflow into the drive-shaft 83 and motor 81. As ice is moved around in the bin 12, melt water is firstly swept into the drain slot 71, and then scraped into the slot 71 as ice and water are pushed over the recessed screen 76 and then over the downstream slot edge 77. All melt water drains to the back and to the drain 70 and to the side opposite from the discharge chute 40, with the rearwardly canted bin bottom 13.

In the combination ice and beverage dispensing apparatus 100, melt-down of ice for cooling beverage presents a very large quantity of melt water that must be disposed of to give relatively dry ice and to maintain a high rate of heat transfer from the ice into the cold plate 101. The drain structure 111 has been found to operate exactly as the previously described drain 70. The rotor 20 revolves over the cold plate 101 and the paddlewheels 25 revolve in a sweep over the annular flange 117 and the cold plate 101. The cold plate 101 required a considerable quantity of ice for beverage cooling, and as the agitator 35 turns over ice in the bin 12, any excessively large ice ends up passing through the rotor open center section 34 and onto the cold plate 101 where this too-largely-sized ice is consumed as cooling medium until it is small enough to pass under the drive ring 23. The drive ring 23 and sizing rings 30–32 will not pass ice into the paddlewheels 25 if the ice is too large to be expelled out of the discharge port 43, or if the ice is of an undesirably large size.

Although various minor modifications may be suggested by those versed in the art, it should be understood that we wish to embody within the scope of the patent warranted hereon all such embodiments as reasonably come within the scope of our contribution to the art.

We claim as our invention:

1. Apparatus for dispensing particulate ice and beverage, comprising:

a. an ice bin having upright walls;

b. a cold plate in a bottom of the bin, said cold plate having heat exchange means for cooling beverage flowing therethrough by melting of ice in the bin and atop the cold plate;

c. an ice dispensing chute extending from the bin; and d. an ice dispensing rotor directly above the cold plate, said rotor being selectively rotatable for expelling particulate ice out of the bin and into the dispensing chute, said rotor having:

(1) a plurality of arcuately spaced apart paddlewheels on the outside of the rotor, for said expelling of the ice into the chute, (2) entry means on top of the paddlewheels for precluding entry of oversize ice into arcuate spaces between adjacent paddlewheels, and (3) a substantially open center section within the paddlewheels and entry means, the oversize ice being freely passable through the center section and onto the cold plate, for consumption of the oversize ice as cooling medium.

2. Apparatus according to claim 1, in which the discharge chute has a bottom surface substantially co-planar with a top surface of the cold plate.

3. Apparatus according to claim 1, in which the rotor includes inside means on the inside of the paddlewheels for precluding sliding of oversize ice across the surface of the cold plate into said spaces between the paddlewheels.

4. Apparatus according to claim 3, in which the inside means comprises a toroidal drive ring to which all of the paddlewheels are mounted, said drive ring being spaced from the cold plate a distance similar to the size of an opening in the entry means.

5. Apparatus according to claim 4, in which the entry means are spaced from the ring a distance similar to the distance between the ring and the cold plate.

6. Apparatus according to claim 1, in which the entry means structurally ties the paddlewheels together.

7. Apparatus according to either of claims 1 or 6, in which the entry means are welded to tops of the paddlewheels.

8. Apparatus according to either of claims 1, 4, 5 or 6, in which the entry means comprises at least one sizing ring mounted atop of the paddlewheels.

9. Apparatus according to claim 8, including a plurality of progressively larger said sizing rings spaced similarly from each other and one inside of another.

10. Apparatus according to either of claims 1, 3, 4, 5 or 6, in which the rotor includes agitator means above the paddlewheels and the entry means, for agitating particulate ice above the entry means.

11. Apparatus according to either of claims 3 or 4, in which the rotor includes means for moving oversize ice within the inside means around on the cold plate.

12. Apparatus according to either of claims 1 or 6, including a bumper atop of the entry means, said bumper being relatively fixed with respect to the rotor, for bumping oversize ice particles up and off of the entry means.

13. Apparatus according to claim 12, in which said bumper is a cantilevered resilient spring bar.

14. Apparatus according to claim 12, including a shelf atop of the entry means and projecting into the bin from above the dispensing chute, said shelf being fixed with respect to the bumper and being behind the bumper.

15. Apparatus according to either of claims 4 or 5 in which at least part of the sizing means is mounted directly above the drive ring.

16. Apparatus according to claim 12, including an upwardly inclined cam on the bumper bar, said cam being above the entry means.

17. In beverage dispenser apparatus having an ice bin, and a cold plate heat exchanger at the bottom of the bin, with ice being placeable in the bin and upon the plate for cooling beverage passed through the plate; the improvement comprising:

a. a rabbet around an upper surface of the cold plate, said upper surface being the bottom of the ice bin;

b. an upright tubular shell mounted in the rabbet and to the plate, said shell extending upwardly and being the side wall of the ice bin;

c. adhesive watertightly sealing the shell in and to the rabbet;

d. thermal insulation physically secured to and enclosing the outside of both of the shell and the cold plate, said insulation structurally retaining the shell to the plate;

e. an annular flange on the bottom of the upright shell, said flange being in and sealed to the rabbet by the adhesive, the top of said annular flange being substantially flush with the cold plate upper surface; and f. an ice dispenser rotor mounted adjacent the cold plate, said rotor being revolvable in a sweep directly above both of the cold plate and the shell annular flange.

18. Apparatus according to claim 17, in which the shell includes a transverse ice discharge chute having a generally horizontal bottom surface which is substantially co-planar with the annular flange and the cold plate upper surface.

19. In beverage dispenser apparatus having an ice bin, and a cold plate heat exchanger at the bottom of the bin, with ice being placeable in the bin and upon the plate for cooling beverage passed through the plate;

the improvement comprising a unitized bin construction having:

a. a rabbet around an upper surface of the cold plate, said upper surface being the bottom of the ice bin;

b. an upright tubular shell mounted in the rabbet and to the plate, said shell extending upwardly and being the side wall of the ice bin;

c. adhesive watertightly sealing the shell in and to the rabbet;

d. thermal insulation physically secured to and enclosing the outside of both of the shell and the cold plate, said insulation structurally retaining the shell to the plate and having a substantially planar bottom surface and skin; and e. means for mounting of the bin, cold plate and insulation in and to the apparatus, said mounting means being on the insulation bottom surface.

20. Apparatus according to claim 19 in which the tubular shell is substantially vertical, in which the cold plate is canted rearwardly, and in which the insulation bottom surface and skin is substantially horizontal.

21. Apparatus according to either of claims 19 or 20, including an ice outlet through the bin and selectively operable means for expelling ice from within the bin and out of said outlet, said expelling means being rotatable about an axis which is perpendicular to the cold plate upper surface and which is canted from vertical, said expelling means being connected to a motor suspended from said insulation.

22. Apparatus according to either of claims 19 and 20 in which the insulation is integral and foamed in place about a previously adhesively sealed together cold plate and shell, said cold plate being insulated from said mounting means by the insulation.

23. In ice dispenser apparatus having an ice bin for containing ice to be dispensed, and selectively operable means for expelling ice from within the bin, the improvement comprising:

a. a transverse generally horizontal ice discharge chute having an outlet end, an inlet end connected to the bin, and a transverse bottom slanted downward from the outlet end to the inlet end;

b. a bin bottom which is at a level lower than a level of the inlet end of the chute bottom;

c. said expelling means being rotatable about a substantially upright axis for expelling ice on the bin bottom transversely out of the chute;

d. drain means having an inlet at a level below the level of the chute bottom for draining melt water off of the chute and the bin bottom, said drain means being fluidly connected into the bin via the bin bottom; and e. in which the bin bottom is the upper surface of a cold plate heat exchanger having therein beverage cooling coils, said cold plate being dependent upon ice within the bin for cooling, said expelling means being operable adjacent to and over the cold plate upper surface for moving ice around on the cold plate, and into the chute from atop of the cold plate, and in which said drain means is connected for draining all melt water from out of the chute and from off the cold plate upper surface.

24. Apparatus according to claim 23 in which the bin bottom is substantially planar and in which the draining means includes an elongate slot extending radially from a center of the bin bottom.

* * * * *